US010821699B2

(12) United States Patent
Jonker

(10) Patent No.: US 10,821,699 B2
(45) Date of Patent: Nov. 3, 2020

(54) CREASING UNIT FOR CREATING FOLD LINES IN CARDBOARD, BLANK FORMING APPARATUS COMPRISING SUCH CREASING UNIT AND METHOD FOR CREATING FOLD LINES IN CARDBOARD

(71) Applicant: Neopost Technologies, Bagneux (FR)

(72) Inventor: Melle Jonker, Drachten (NL)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 25 days.

(21) Appl. No.: 15/597,475

(22) Filed: May 17, 2017

(65) Prior Publication Data

US 2017/0355166 A1 Dec. 14, 2017

(30) Foreign Application Priority Data

Jun. 9, 2016 (DE) ..... 10 2016 110 654
Sep. 29, 2016 (EP) ..... 16 191 536

(51) Int. Cl.

| | |
|---|---|
| ***B31F 1/08*** | (2006.01) |
| ***B31F 1/10*** | (2006.01) |
| ***B31B 50/26*** | (2017.01) |
| *B31B 50/25* | (2017.01) |

(52) U.S. Cl.

CPC ..... *B31F 1/08* (2013.01); *B31B 50/26* (2017.08); *B31F 1/10* (2013.01); *B31B 50/25* (2017.08); *B31B 50/256* (2017.08); *B65B 2210/04* (2013.01)

(58) Field of Classification Search

CPC ..... B31F 1/08; B31F 1/10; B31B 1/26; B31B 50/256; B31B 2201/25; B65B 2210/04

USPC ..... 493/396

See application file for complete search history.

(56) References Cited

U.S. PATENT DOCUMENTS

| | | | | |
|---|---|---|---|---|
| 1,998,357 A * | 4/1935 | Carison | B26D 9/00 | 83/425 |
| 2,242,514 A * | 5/1941 | De Smith | B26D 7/2635 | 411/116 |
| 3,648,605 A * | 3/1972 | Hottendorf | B31F 1/10 | 101/232 |

(Continued)

FOREIGN PATENT DOCUMENTS

| | | |
|---|---|---|
| EP | 2474397 A1 | 7/2012 |
| WO | 2010/029416 A2 | 3/2010 |
| WO | 2014/117817 A1 | 8/2014 |

OTHER PUBLICATIONS

Extended European Search Report, dated Jul. 11, 2017, for European Application No. 16191536.8-1708, 5 pages.

*Primary Examiner* — Sameh Tawfik
(74) *Attorney, Agent, or Firm* — Cozen O'Connor

(57) ABSTRACT

A creasing unit for creating fold lines in cardboard, comprising two crease rollers, each crease roller having a circumferential protrusion adapted for indenting cardboard to create a fold line, wherein the crease rollers are rotatably mounted next to each other such that each crease roller can rotate about its own center axis and each crease roller is movable between at least a first position for creating a fold line and a second position for either allowing cardboard to pass the respective crease roller without being indented by the respective crease roller or for creating an additional indented line being less deep than the fold line.

9 Claims, 8 Drawing Sheets

(56) References Cited

U.S. PATENT DOCUMENTS

| | | | | | |
|---|---|---|---|---|---|
| 3,690,138 | A * | 9/1972 | Weber | B21B 1/42 | 72/189 |
| 3,915,404 | A * | 10/1975 | Kampf | B65H 18/10 | 242/547 |
| 4,006,656 | A * | 2/1977 | Shinomiya | B26F 3/004 | 493/60 |
| 4,080,878 | A * | 3/1978 | Gallagher | B31F 1/10 | 425/363 |
| 5,158,525 | A * | 10/1992 | Nikkel | B26D 7/2635 | 384/248 |
| 5,335,532 | A * | 8/1994 | Mueller | B21D 22/28 | 100/282 |
| 5,458,034 | A * | 10/1995 | Cavagna | B26D 1/185 | 83/488 |
| 5,588,344 | A * | 12/1996 | Chun | B21D 28/20 | 83/13 |
| 5,888,183 | A * | 3/1999 | Ruthenberg | B31F 1/10 | 493/160 |
| 6,082,255 | A * | 7/2000 | Gundal | B26D 5/18 | 100/215 |
| 6,409,118 | B1 * | 6/2002 | Hutzenlaub | B65H 18/26 | 242/547 |
| 6,413,150 | B1 * | 7/2002 | Blair | B28D 5/029 | 451/41 |
| 6,684,749 | B2 * | 2/2004 | Adami | B23D 35/008 | 156/269 |
| 8,196,502 | B2 * | 6/2012 | von Freden | B65H 45/30 | 83/114 |
| 8,388,508 | B2 * | 3/2013 | Wetsch | B31D 5/0052 | 493/459 |
| 8,398,533 | B2 * | 3/2013 | Tsunoda | B65H 45/30 | 493/396 |
| 2008/0020916 | A1 | 1/2008 | Magnell | | |

* cited by examiner

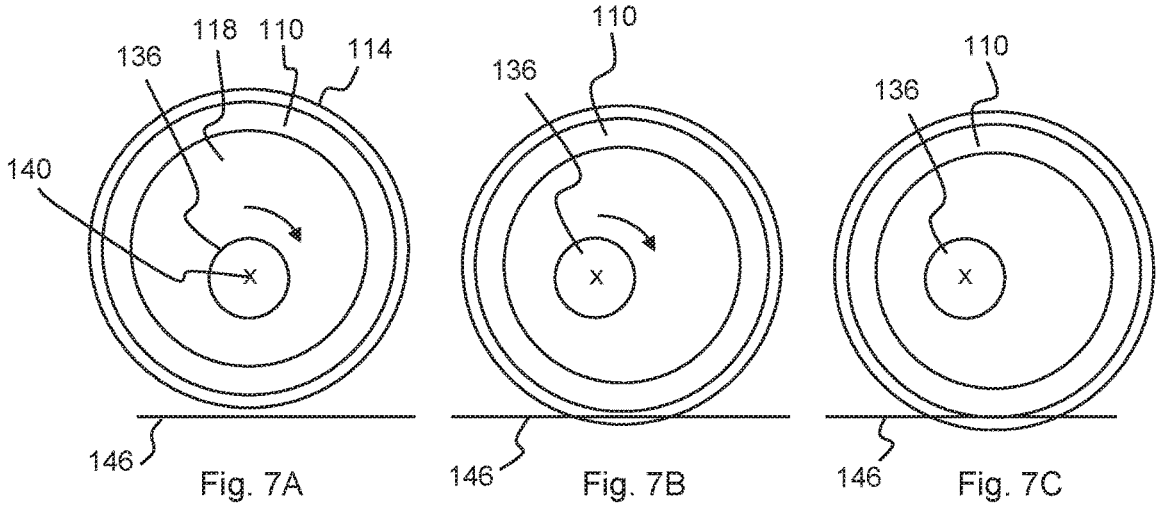
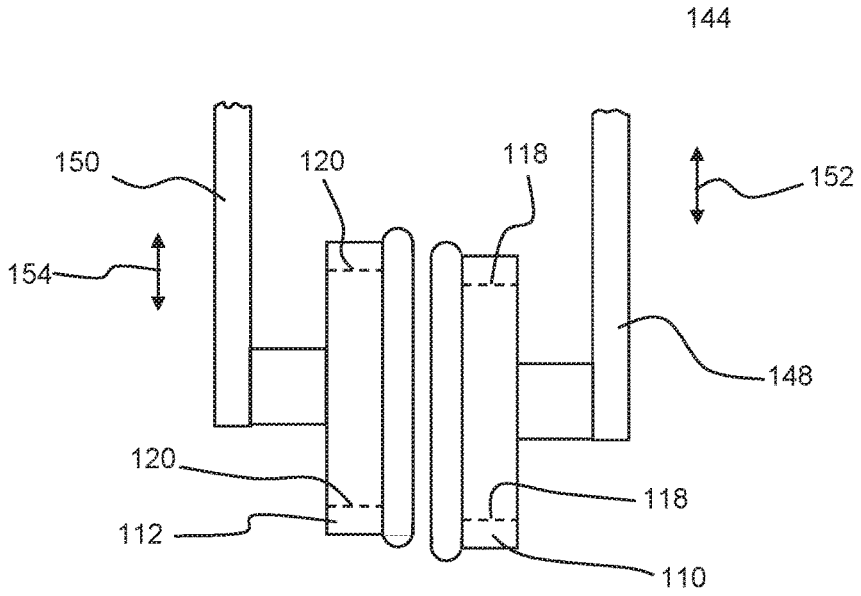
Fig. 8

CREASING UNIT FOR CREATING FOLD LINES IN CARDBOARD, BLANK FORMING APPARATUS COMPRISING SUCH CREASING UNIT AND METHOD FOR CREATING FOLD LINES IN CARDBOARD

TECHNICAL FIELD

The subject matter described herein relates to a creasing unit for creating fold lines in cardboard, in particular cardboard blanks, as used in automatic cardboard folding systems. The subject matter also relates to a blank forming apparatus comprising such creasing unit and a method for creating fold lines in cardboard, in particular cardboard blanks.

BACKGROUND

In recent years, mail ordering has become increasingly common. In order to cope with the increased need for packaging mail ordered items, different systems and methods for automatically forming packaging boxes have been proposed.

While assembling a shipment in a warehouse is nowadays often done more or less fully automated, packaging the items to be shipped is still a challenge, in particular when a shipment comprises several items of different sizes and in different quantities. Often, the items to be packaged are provided automatically to a person packaging the items manually. Depending on the size and number of the items, the person selects a suitable box size. Generally the box is a cardboard box that upon packaging is assembled from a corresponding cardboard blank.

US 2008/0020916 A1 discloses a box-making machine, which executes creasing and cutting steps to obtain a cardboard blank, which is then folded to obtain a packaging box from the blank. The apparatus, methods and components described in the present application may be advantageously used in the type of machine described in US 2008/0020916 A1 and similar types of machines.

To automate the packaging process even in cases where the items vary in size and number, a system has been proposed in WO 2014/117817 A1 that allows creating a custom sized box from a roll or a stack of cardboard by cutting out and creasing a custom sized blank from which then a suitable box is folded automatically. FIG. 1 shows such box folding apparatus in a situation, where it has just started folding the bottom part of a packaging box from a cardboard blank.

FIG. 2 depicts an intermediate state of forming a packaging box from a cardboard blank, from which the terminology used in the present description with respect to the single panels of the blank can easily be understood. Both, FIG. 1 and FIG. 2 will later be described in more detail. While FIG. 2 depicts a box with an "integrated" cover, it should be understood that the subject matter described in the present application relates to creating fold lines (also known as crease lines) in cardboard in general. For example, the subject matter described in the present application can be used for creating fold lines in blanks for folding open boxes or lids.

DISCLOSURE OF THE EMBODIMENTS OF THE INVENTION

Known blank forming apparatus use two single crease rollers to create two parallel fold lines 52 and 54 as shown in FIG. 3 along the feeding direction indicated by arrow 56, in which cardboard is fed through a blank forming apparatus. The fold lines 52 and 54 run over the entire length 58 of a respective blank. The known crease rollers are continuously active and have to be set at the correct position before the cardboard arrives. The "correct position" depends on the dimensions wanted for the respective panels of the blank that are delimited against each other by the fold lines.

However, as the cardboard has a certain thickness, a continuous straight fold line, about which panels are folded that in the folded state lie on top of each other, is obviously disadvantageous as it would per se prevent that the panels could be folded to be in two exact parallel planes. The prior art uses the fact that the cardboard has a certain flexibility which allows the panels to be folded into positions, in which stiff panels would collide. Nevertheless, the free ends of the respective panels tend to diverge. While the panels that in the folded state form the outer parts of a respective box are usually taped or glued to other panels, such that the outside of a respective box more or less has a decent look, the inner panels often jut towards the inner side of a respective box giving the inside a poor look. Moreover, besides these aesthetic aspects, boxes created in the known way are not as stable as boxes could be, would the panels, which in the folded state lie on top of each other, be folded such that they could run in parallel planes. The apparatus and methods described herein allow creating longitudinal (with respect to the feeding direction) fold lines in cardboard, which are offset with respect to each other to account for the thickness of the respective cardboard without negatively affecting the speed, at which cardboard is fed through a respective apparatus.

The object is achieved by a creasing unit according to the claims. A creasing unit according to the apparatus and methods described in the present application allows switching from one position, where a fold line is created by indenting cardboard, to another position, such that two laterally slightly offset fold lines can be created without relevant interruptions in the longitudinal direction. This can be done on the fly, i.e. while feeding cardboard past respective crease rollers. Thus, blanks can be formed, of which the respective panels can be folded to be perfectly perpendicular respectively parallel to each other. Major advantage of a creasing unit according to the apparatus and methods described in the present application is that existing blank forming apparatus can easily be refitted with respective creasing units. Further details and advantages will become apparent from the following description of embodiments of the invention, which are given as non-limiting examples.

BRIEF DESCRIPTION OF THE DRAWINGS

FIG. 7 is a schematic drawing of a crease roller according to FIG. 6 in plan view in three different rotational positions.

FIG. 8 shows schematically details of a creasing unit according to a second embodiment.

DESCRIPTION OF PREFERRED EMBODIMENTS

Figure 1:
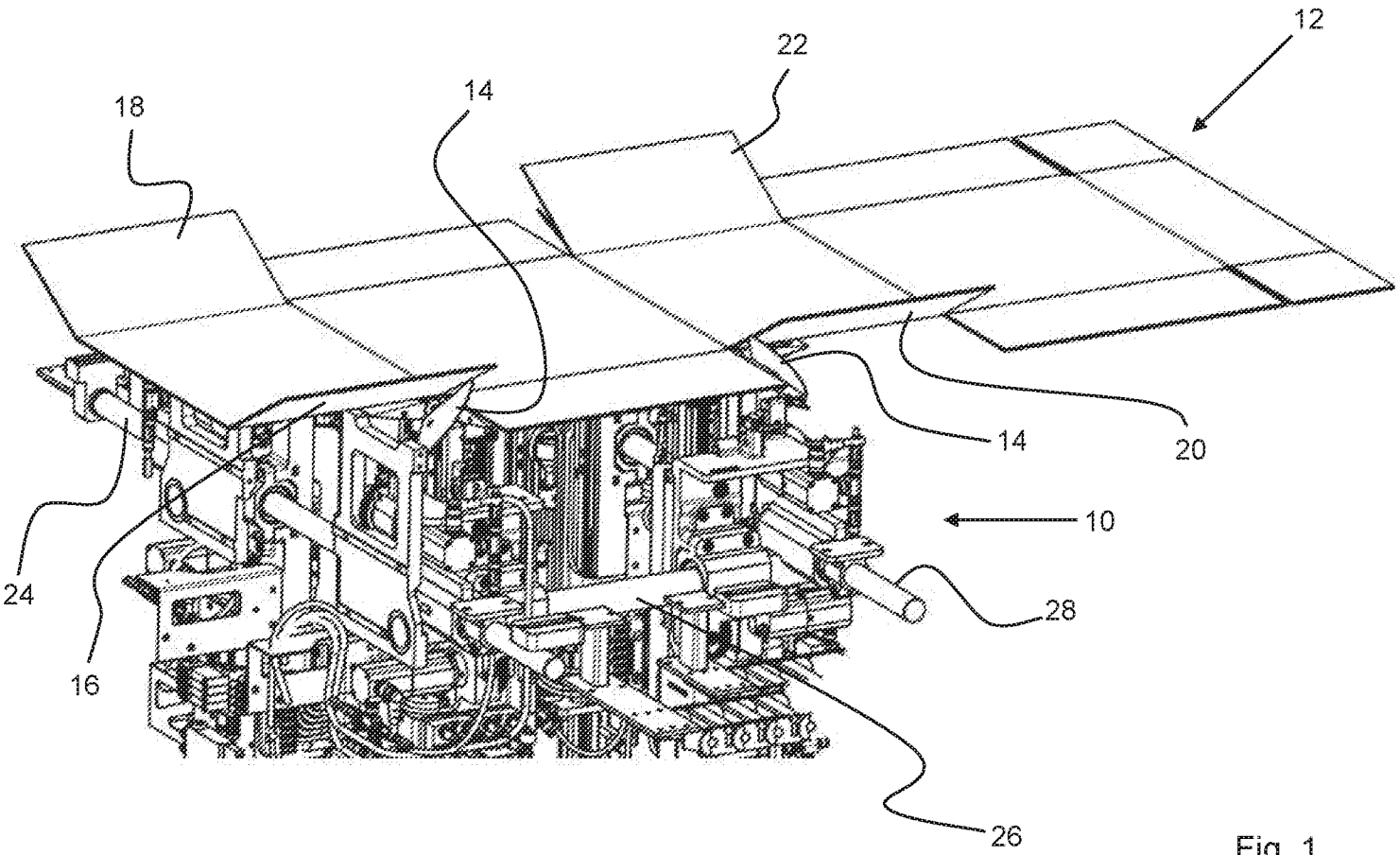
FIG. 1 shows schematically a box folding apparatus in a situation, where it has just started folding the bottom part of a cardboard box from a cardboard blank.

FIG. 1 shows schematically some parts of a folding apparatus 10 for folding cardboard blanks to form packaging boxes. The apparatus comprises four folding units, each comprising a corner panel folding element 14. In the shown situation, a cardboard blank 12 has been placed on the folding apparatus and the corner panel folding elements 14 have started to push the corner panels 16, 18, 20 and 22 upwards.

The folding units are slidably mounted on rods 24, 26 and 28 in order to be moveable in a plane parallel to the plane of the cardboard blank 12, as the cardboard blanks to be folded may differ in size and hence the positions of the panels of the cardboard blank to be folded by the folding apparatus may vary from blank to blank.

The folding apparatus 10 usually forms part of an automatic packaging system, in which custom sized boxes can be created from cardboard fed into the system usually from zig-zag folded stacks of cardboard and in which items to be shipped are automatically packaged in the boxes formed. Such system is disclosed for example in WO 2014/117817 A1, the disclosure of which is incorporated herein by reference. Such automatic packaging system comprises a blank forming apparatus, in which the cardboard is cut and creased to form a custom sized blank, which then can be folded automatically.

Figure 2:
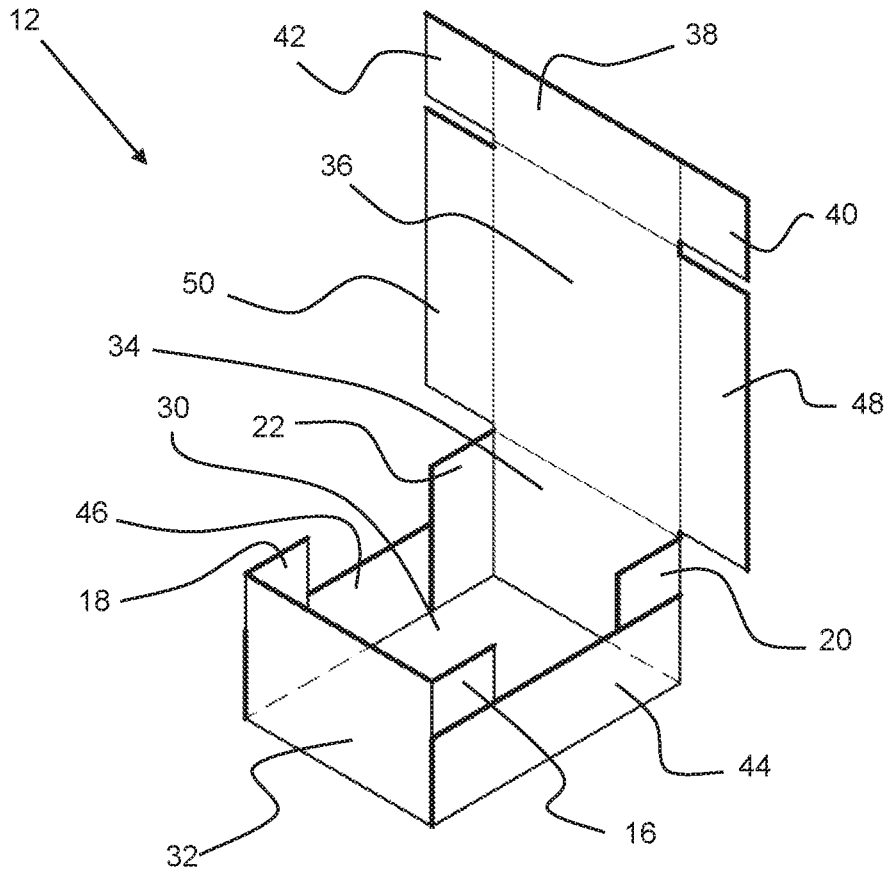
FIG. 2 shows a cardboard blank in a situation, where it has been folded to form the bottom part of a packaging box.

FIG. 2 depicts a cardboard blank 12 in a situation, where it has been folded so far that the bottom part of a packaging box is formed. Cardboard blank 12 comprises a bottom panel 30, to which two end panels 32 and 34 are attached, and a top panel 36, to which end panel 38 is attached. By "attached" it is meant that the respective panels are connected with each other. In fact, all panels are integrally formed by creasing and cutting a single cardboard blank. In this sense, corner panels 16 and 18 already mentioned above are "attached" to end panel 32, corner panels 20 and 22 already mentioned above are attached to end panel 34, and corner panels 40 and 42 are attached to end panel 38. Furthermore, side panels 44 and 46 are attached to bottom panel 30, and side panels 48 and 50 are attached to top panel 36. Two panels attached to each other are delimited against each other by fold lines, which form "hinges" about which the respective panels shall be folded to form a box. As mentioned above, the apparatus and methods described in the present application may also be used for creating blanks for open boxes or lids, for example a box comprising only one base panel such as bottom panel 30, two side panels, two end panels and four corner panels.

Figure 3:
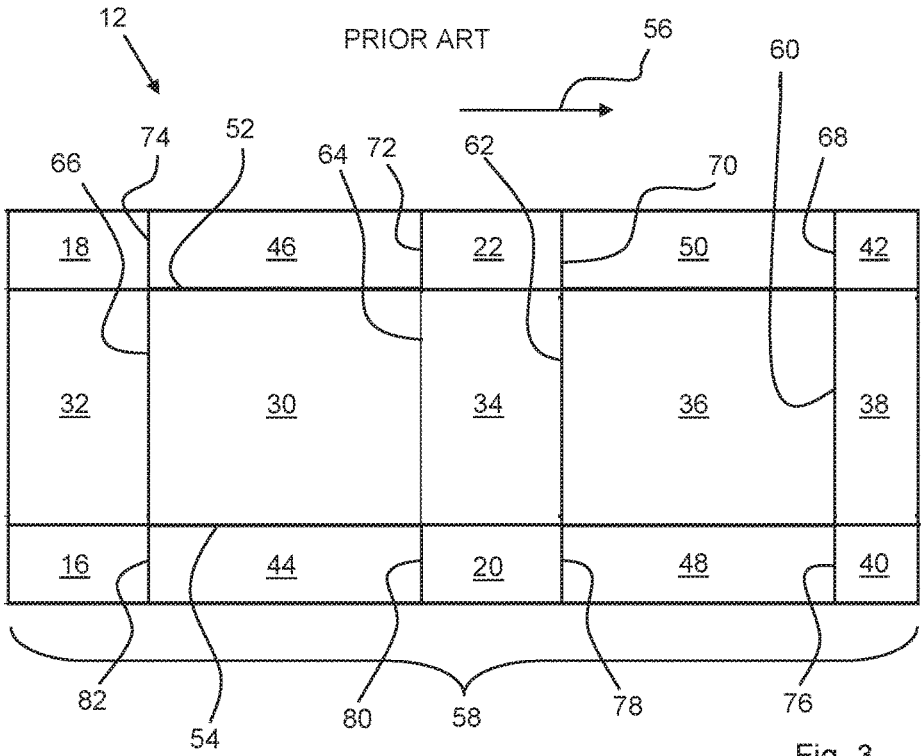
FIG. 3 shows schematically a cardboard blank according to the prior art.

FIG. 3 schematically depicts a cardboard blank 12 with fold lines formed according to the prior art. According to the prior art, two parallel fold lines 52 and 54 are formed in the feeding direction 56, in which cardboard is fed through a blank forming apparatus, over the entire lengths 58 of the blank 12. Accordingly, panels 18, 46 and 22 respectively panels 22, 50 and 42 as well as panels 16, 44 and 20, respectively 20, 48 and 40, which in the folded state as partially shown in FIG. 2 would at least partially lie on top of each other, cannot be folded into perfectly parallel planes since each panel has a certain thickness. Besides, four parallel fold lines 60, 62, 64 and 66 are formed between end panel 38 and top panel 36, respectively between top panel 36 and end panel 34, respectively between end panel 34 and bottom panel 30, respectively between bottom panel 30 and end panel 32. In order to "free" adjacent side and corner panels, cuts 68, 70, 72 and 74 respectively 76, 78, 80 and 82 are provided between corner panel 42 and side panel 50, respectively between side panel 50 and corner panel 22, respectively between corner panel 22 and side panel 46, respectively between side panel 46 and corner panel 18, respectively between corner panel 40 and side panel 48, respectively between side panel 48 and corner panel 20, respectively between corner panel 20 and side panel 44, respectively between side panel 44 and corner panel 16.

Figure 4:
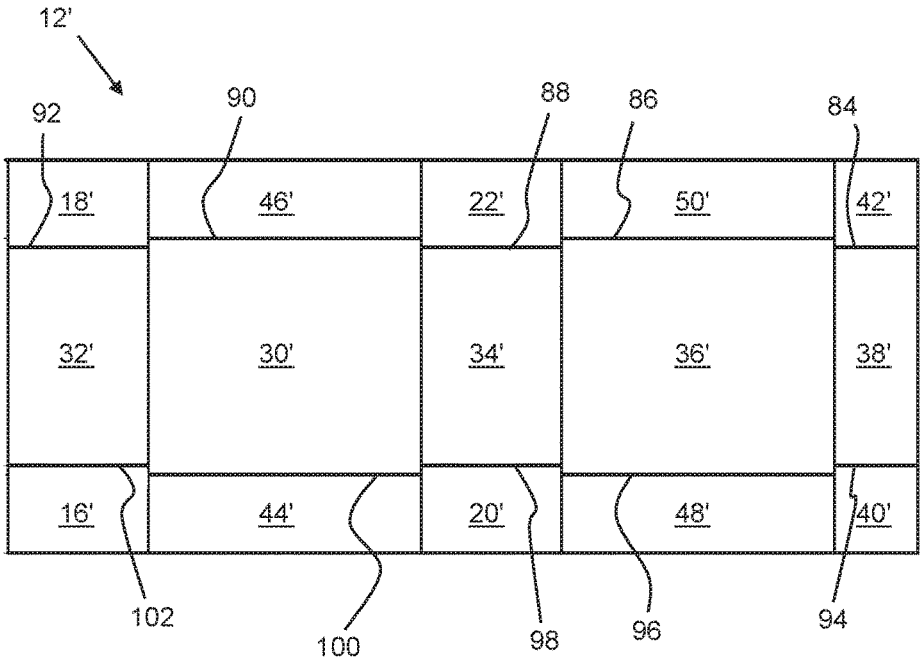
FIG. 4 shows schematically a cardboard blank being provided with fold lines according to at least one embodiment of the invention.

FIG. 4 shows a blank 12', in which the fold lines 84, 86, 88, 90 and 92, respectively 94, 96, 98, 100 and 102 between the respective corner panels 16', 18', 20', 22', 40, 42' and the end panels 32', 34', 38', respectively between the respective side panels 44', 46' and the bottom panel 30', respectively between the top panel 36' and the respective side panels 48', 50', are shifted or offset with respect to each other by an amount corresponding to approximately the thickness of the cardboard, so that e.g. panels 18' and 46' can be folded into perfectly parallel planes. It should be noted that the drawings are intended for facilitating the understanding of the various embodiments of the invention and are of schematic nature so that the offset between adjacent fold lines such as fold lines 90 and 92 is not shown to scale. Cardboard used for forming boxes typically has a thickness of about 2 to 5 mm and accordingly the offset between adjacent fold lines 90 and 92 or 86 and 88 is approximately 2 to 5 mm. As explained later, the offset between the fold lines can be advantageously adjusted to the thickness of the cardboard used.

Figure 5:
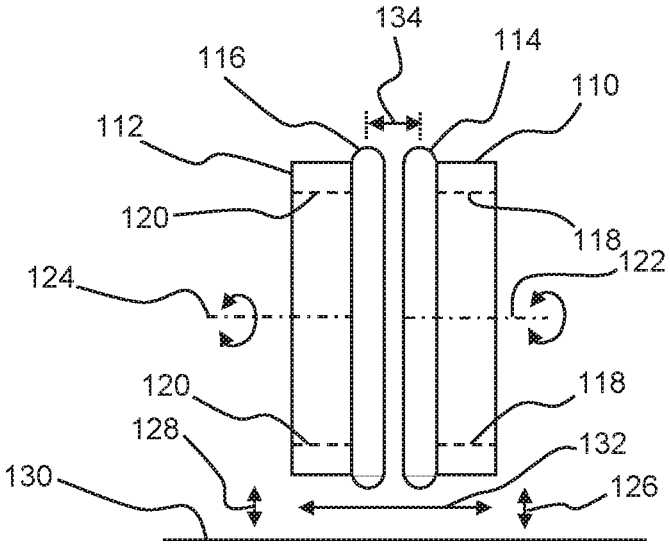
FIG. 5 shows schematically the different movements two crease rollers according to one embodiment of the invention are able to make.

FIG. 5 shows schematically two crease rollers 110, 112, each having a circumferential protrusion 114, 116 adapted for indenting cardboard to create a fold line. Each crease roller 110, 112 is rotatably mounted on its own bearing integrated in the roller as indicated by dashed lines 118, 120, so that each roller can rotate about its own center axes 122, 124. A respective bearing is shown in plan view in FIG. 7. It is obvious for an expert in the art that the crease rollers do not need to be thicker in the axial direction than their respective protrusion. The term "protrusion" is used herein to indicate that the radial outermost part of the crease roller must have a certain shape adapted for indenting cardboard as known to the experts in the art.

As indicated by arrows 126, 128, the distance of each crease roller 110, 112 to a plane 130 running parallel to the center axes 122, 124 of the crease rollers 110, 112 is adjustable. In use, cardboard would be fed past the crease rollers parallel to plane 130, so that by changing the distance of each crease roller 110, 112 in the directions of arrows 126, 128, cardboard could be brought into contact with one of the protrusions 114, 116 and would accordingly be indented.

In order to allow forming custom sized blanks, in a preferred embodiment the crease rollers are movable parallel to plane 130 as indicated by arrow 132.

In order to allow adapting a crease unit comprised of two crease rollers 110, 112 to different cardboard thicknesses, in a preferred embodiment the distance between the crease rollers is adjustable as indicated by arrow 134.

All aforementioned movements can be achieved by different embodiments, each having certain advantages.

Figure 6:
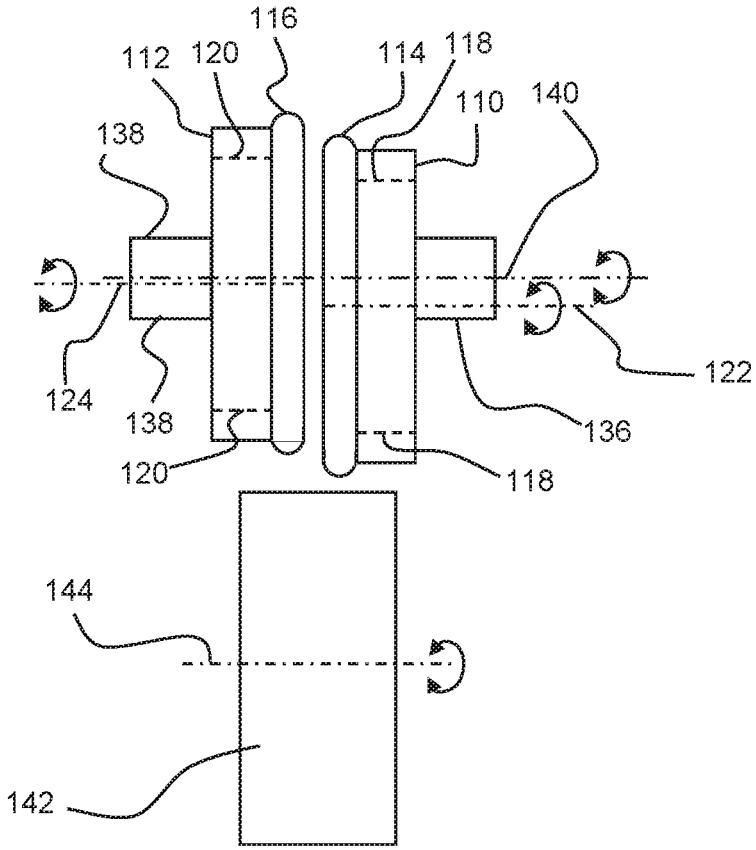
FIG. 6 shows schematically a first embodiment of a creasing unit according to at least one embodiment of the invention, comprising two crease rollers eccentrically mounted on separate rotatable rods.

FIG. 6 shows a creasing unit comprised by two crease rollers 110 and 112, each being rotatably mounted about its own center axes 122, 124 via a respective bearing indicated by dashed lines 118 respectively 120. The bearings itself are eccentrically mounted on separate rods 136, 138, which have a common axis of rotation 140. By turning the crease rollers 110, 112 about the axis 140, each crease roller 110, 112 can be moved independently of the other crease roller between two extreme positions, namely a "fully active" position, at which the respective roller is brought into close proximity to a counter wheel 142, which is arranged for pressing cardboard against the respective crease roller, and—in this embodiment—a "fully passive" position, in which cardboard can pass the respective crease roller without being indented. Advantageously, each crease roller can be positioned anywhere in between those extreme positions, allowing to adjust the distance between the indenting protrusions 114, 116 and the counter wheel 142 for example to handle cardboard of different thicknesses and/or or to produce indentations of different depths. In particular, it is also possible to bring both crease rollers 110, 112 in an active position, in which both cerate indentations but of different depths, which for certain cardboard types can be advantageous, as will be explained later. Thus, while in this embodiment each crease can be moved into a fully passive position, generally the crease rollers should be movable between at least a first position for creating indentations of a first depth and a second position for either allowing the cardboard to pass the respective crease roller without being indented or for creating indentations of a second depth.

In the state shown in FIG. 6, crease roller 110 is in its active position while crease roller 112 is in its passive position. Cardboard fed through the gap between counter wheel 142 and crease roller 110 would then be indented by protrusion 114. The counter wheel 142 is rotatable about an axis 144 and is advantageously a driven wheel that has a double function of pressing cardboard against a crease roller and transporting cardboard through a respective apparatus.

In a preferred embodiment, at least one of the rods 136, 138 is not only movable about axis 140, but also independently of the other rod along the axis 140, so that the distance between crease roller 110 and crease roller 112 can be adjusted. If both rods are moved along the axis, the creasing unit can be adjusted to different blank dimensions.

FIGS. 7A, 7B, and 7C show the crease roller 110 of FIG. 6 in plan view in three different rotational states about axis 140 of rod 136, the center of the axis being indicated by "x". Since crease roller 110 is eccentrically attached to rotatable rod 136 via bearing 118, by turning rod 136 crease roller 110 can be moved between its active and its passive positions. It is worth noting and important to understand that the term "active position" means any position, in which protrusion 114 indents a cardboard passing crease roller 110, and that the term "passive position" means any position, in which protrusion 114 does not indent a cardboard. Hence, there are different active positions, of which two are shown in FIGS. 7B and 7C, and different passive positions, of which only one is shown in FIG. 7A. If line 146 would be the surface of cardboard passing the crease roller 110, it would not be indented in the situation shown in FIG. 7A, while it would be indented with different depths in FIGS. 7B and 7C. It is obvious for an expert that by turning crease roller 110 about axis 140, not only the depth of a fold line can be adjusted, but also cardboard of different thicknesses can be processed by a corresponding creasing unit, since the distance between a crease roller and a corresponding counter wheel or a supporting device having a function of providing support for cardboard when being indented by the crease roller is adjustable.

FIG. 8 shows another embodiment of a creasing unit. Again, two crease rollers 110, 112 are provided, each being rotatably mounted on a bearing 118, 120, but in this embodiment the bearings are attached to arms 148, 150 (only partially shown), which can be transversally moved as indicated by arrows 152, 154. The arms can be attached to separate cylinder-plunger units or other push-and-pull devices for moving the crease rollers 110, 112 via the arms 148, 150 between their active and passive positions.

Instead of enabling each crease roller to be moved independently of the other crease roller between its active and passive positions, for certain applications it is advantageous to mount the crease rollers to be simultaneously movable inversely to each other such that when one of the crease rollers is moved from a first to a second position, the other crease roller is automatically moved from a second to a first position, the first position being a position at which indentations of a first depth are created and the second position being a position at which either the cardboard is allowed to pass the respective crease roller without being indented or at which indentations of a second depth are created, the second depth being less than the first depth. To achieve this, the arms 148, 150 shown in FIG. 8 could e.g. be attached to a rocker for moving the arms inversely up and down. Another way of mounting the crease rollers to be simultaneously movable inversely to each other is shown in FIG. 9.

Figure 9:
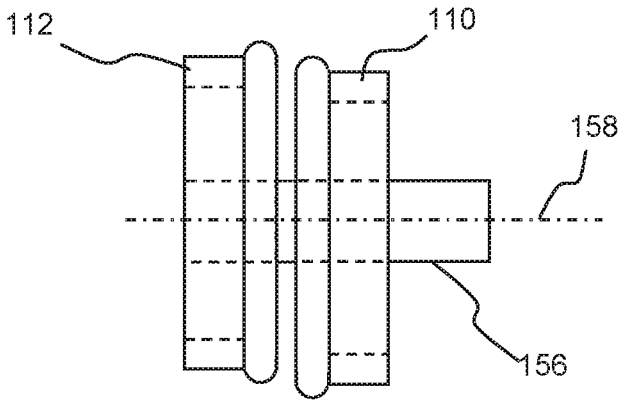
FIG. 9 shows schematically details of a creasing unit according to a third embodiment.

In FIG. 9, two crease rollers 110, 112 are each eccentrically mounted on a single rod 156 such that by turning the rod 156 about its axis 158, the crease rollers 110, 112 are simultaneously moved inversely to each other.

Figure 10:
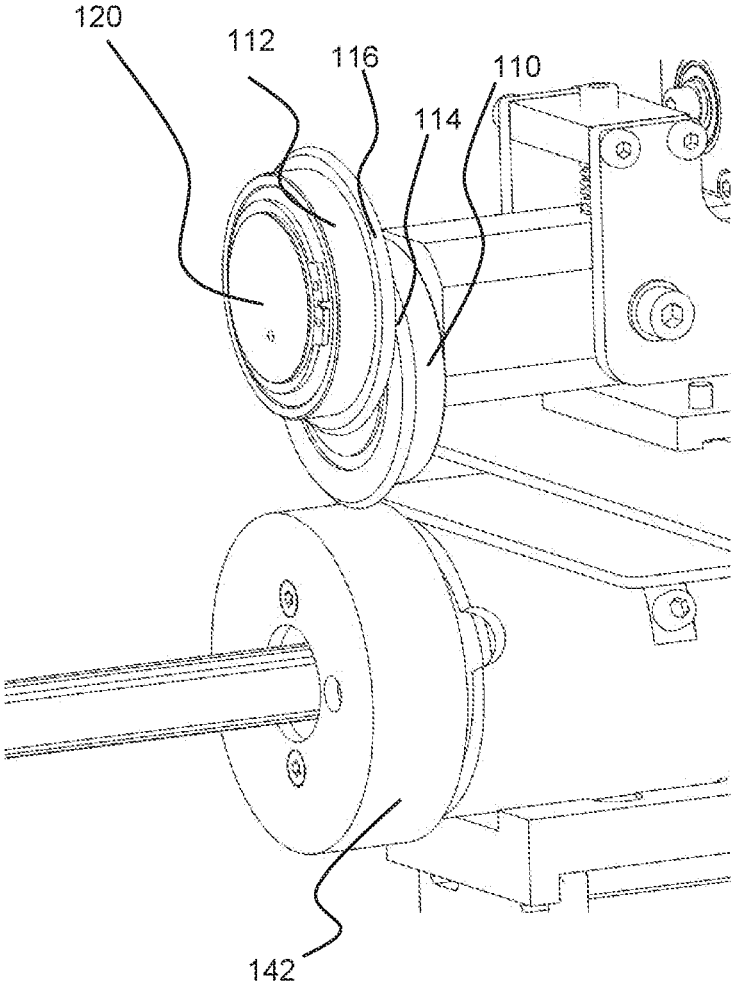
FIG. 10 is a perspective drawing of a creasing unit according to a fourth embodiment.
Figure 11A:
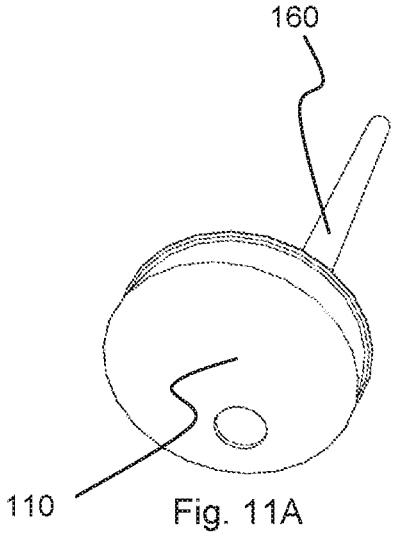
FIGS. 11A and 11B show essential parts of a creasing unit according to FIG. 10 in a disassembled state.
Figure 11B:
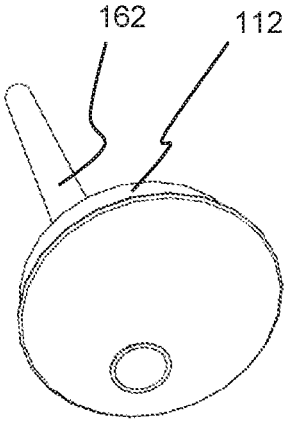
Figure 12:
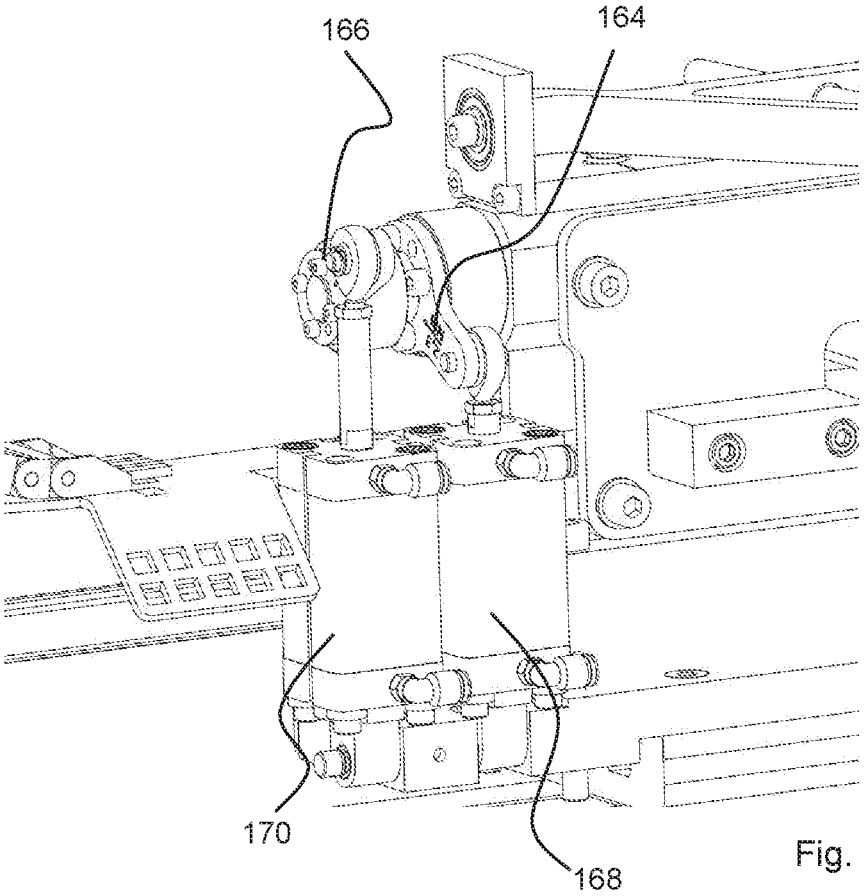
FIG. 12 shows actuators for moving the crease rollers according to FIG. 10 between their respective first and second positions.

FIGS. 10 to 12 depict details of a creasing unit according to the currently preferred embodiment.

FIG. 10 shows two crease rollers 110, 112 each having a protrusion 114, 116 adapted for indenting cardboard, and a counter wheel 142 arranged for pressing cardboard against the crease roller. Each crease roller 110, 112 is mounted via a respective bearing, of which only bearing 120 is visible in FIG. 10, to a separate rod 160, 162 shown in FIGS. 11A and 11B. In the situation shown in FIG. 10, crease roller 110 is in an active position while crease roller 112 is in a passive position.

Rod 162 is a hollow rod having a free inner diameter adapted to accommodate rod 160. Rod 160 is longer than rod 162 such that—when inserted in rod 162—its free end protrudes from the free end of rod 162. The free ends can then be attached for example via levers 164, 166 shown in FIG. 12 to pneumatic actuators 168, 170. The complete crease unit including the actuators can be mounted on a positioning device comprising a drive belt and/or a spindle and/or rods like the rods 24, 26 and 28 depicted in FIG. 1 to make the creasing unit positionable at different positions with respect to a blank being formed in a blank forming apparatus.

In order to allow indenting parallel fold lines 84 to 102 as shown in FIG. 4 on the fly, a corresponding blank forming apparatus comprises two creasing units described above, each comprising a pair of crease rollers. The pairs of crease rollers can be mounted at a distance to each other on a rod such that one roller of each pair is in its first position when the other roller is in its second position. In use, one of the crease rollers of each pair would be brought into an active position (and is hence called "active crease roller"), while the other crease roller of the pair remains in its passive position (and is hence called "passive crease roller") as the blank shown in FIG. 4 is not indented with parallel fold lines of different depths. Cardboard to be indented would be moved past the respective active crease rollers. When the cardboard has been moved towards a position, where a new panel shall start, the active crease rollers are brought into their passive positions and the passive crease rollers are brought into their active positions. The various embodiments of the invention advantageously allow producing cardboard blanks having offset fold lines as shown in FIG. 4 at high production speed without interruptions in the longitudinal direction due to having to reposition a crease roller.

Figure 13:
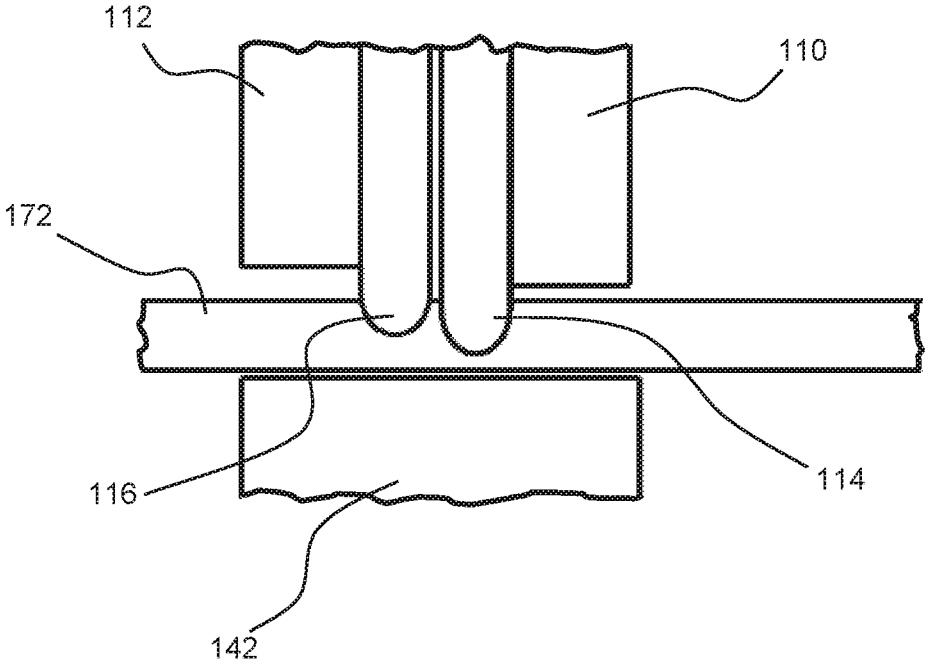
FIG. 13 shows schematically details of a creasing unit according to a fifth embodiment.

FIG. 13 shows schematically details of a creasing unit according to FIG. 6 in a situation, in which parallel indentations of different depths are created in cardboard 172. Both crease rollers 110 and 112 are in active positions such that their circumferential protrusions 114, 116 indent the cardboard 172. Crease roller 110 is in a first position, in which indentations of a first depth are created, and crease roller 112 is in a second position, in which indentations of a second depth are created, the second depth being less than the first depth. For certain cardboard types, in particular for rather stiff cardboard types, it can be advantageous to create not one single fold line but two parallel indented lines of different depths. The deeper line defines the actual position where panels shall be folded (and is hence called "actual fold line"). The additional line compresses the cardboard near the actual fold line and makes it easier to fold rather stiff cardboard, while the fold will still be created at the deeper, actual fold line. The difference in depths of the parallel indented lines can advantageously be adapted depending on the type of cardboard.

The depth of each crease line created by crease rollers 110, 112 can be controlled in many different ways such that an expert in the art can choose the optimal way for the particular installation situation, in which the creasing shall be used. For example, the depth can be controlled using a control unit, a cam disk having a number of positions, or by applying different creasing forces, such that depth becomes a function of the creasing force and the resilience of the cardboard.

| LIST OF REFERENCE NUMBERS | |
|---|---|
| 10 | folding apparatus |
| 12, 12' | cardboard blank |
| 14 | corner panel folding element |
| 16, 16' | corner panel |
| 18, 18' | corner panel |
| 20, 20' | corner panel |
| 22, 22' | corner panel |
| 24 | rod |
| 26 | rod |
| 28 | rod |
| 30, 30' | bottom panel |
| 32, 32' | end panel |
| 34, 34' | end panel |
| 36, 36' | top panel |
| 38, 38' | end panel |
| 40, 40' | corner panel |

-continued

| LIST OF REFERENCE NUMBERS | |
|---|---|
| 42, 42' | corner panel |
| 44, 44' | side panel |
| 46, 46' | side panel |
| 48, 48' | side panel |
| 50, 50' | side panel |
| 52 | fold line |
| 54 | fold line |
| 56 | feeding direction |
| 58 | length of blank |
| 60 | fold line |
| 62 | fold line |
| 64 | fold line |
| 66 | fold line |
| 68 | cut |
| 70 | cut |
| 72 | cut |
| 74 | cut |
| 76 | cut |
| 78 | cut |
| 80 | cut |
| 82 | cut |
| 84 | fold line |
| 86 | fold line |
| 88 | fold line |
| 90 | fold line |
| 92 | fold line |
| 94 | fold line |
| 96 | fold line |
| 98 | fold line |
| 100 | fold line |
| 102 | fold line |
| 110 | crease roller |
| 112 | crease roller |
| 114 | protrusion |
| 116 | protrusion |
| 118 | bearing |
| 120 | bearing |
| 122 | axis |
| 124 | axis |
| 126 | direction |
| 128 | direction |
| 130 | plane |
| 132 | direction |
| 134 | distance |
| 136 | rod |
| 138 | rod |
| 140 | axis |
| 142 | counter wheel |
| 144 | axis |
| 146 | cardboard surface |
| 148 | arm |
| 150 | arm |
| 152 | direction |
| 154 | direction |
| 156 | rod |
| 158 | axis |
| 160 | rod |
| 162 | rod |
| 164 | lever |
| 166 | lever |
| 168 | actuator |
| 170 | actuator |
| 172 | cardboard |

The invention claimed is:

1. A creasing unit to create longitudinally uninterrupted fold lines in cardboard, the creasing unit comprising:

a first pair of two crease rollers, each crease roller of the first pair of two crease rollers having a circumferential protrusion to engage and indent the cardboard to create a respective fold line and rotatable about a respective center axis of the crease roller, and said respective fold line results from indentation of said cardboard with said protrusion, a pair of rods including a first rod and a second rod, at least said first rod being a hollow rod, said crease rollers of the first pair of two crease rollers arranged on respective ones of the rods of the pair of rods, said crease rollers of the first pair of two crease rollers spaced apart from one another along a direction that is transverse to a feed direction of the cardboard, each crease roller of the first pair of two crease rollers movable in a direction perpendicular to a plane of the cardboard between at least a respective first position to create the respective fold line and a respective second position to either allow the cardboard to pass the respective crease roller without being indented by the respective crease roller or to create an additional indented line being less deep than the respective fold line, and wherein the two crease rollers when in the first position create respective ones of fold lines which are laterally offset from one another along the direction that is transverse to the feed direction of the cardboard, and wherein each crease roller of the first pair of two crease rollers is movable between the respective first position and the respective second position of the respective crease roller independently of the other crease roller of the first pair of two crease rollers, and wherein each crease roller of the first pair of two crease rollers is eccentrically attached to and mounted on a respective one of said rods of said pair of rods and at least a portion of said second rod of said pair of rods is accommodated by the hollow rod to move the respective crease roller between the respective first position and the respective second position of the respective crease roller.

2. The creasing unit according to claim 1, wherein the crease rollers of the first pair of two crease rollers are mounted to be simultaneously movable inversely to each other such that when one of the crease rollers is moved from the respective first position to the respective second position of the crease roller, the other crease roller is automatically moved from the respective second position to the respective first position of the other crease roller.

3. The creasing unit according to claim 2, wherein when one of the first or the second crease rollers of the first pair of crease rollers is moved from the respective second position to the respective first position, the other one of the first or the second crease rollers of the first pair of crease rollers is moved from the respective first position to the respective second position.

4. The creasing unit according to claim 3, wherein when the first crease roller of the first pair of crease rollers reaches the first respective position the second crease roller of the first pair of crease rollers reaches the second respective position and when the second crease roller of the first pair of crease rollers reaches the first respective position the first crease roller of the first pair of crease rollers reaches the second respective position to create a longitudinally uninterrupted crease line as the cardboard is continuously feed in the feed direction.

5. The creasing unit according to claim 1, wherein an axial distance between the crease rollers of the first pair of two crease rollers is adjustable.

6. The creasing unit according to claim 1, further comprising at least one counter wheel or a supporting device that provides support for the cardboard when the cardboard is indented by at least one of the crease rollers of the first pair of crease rollers, when the crease roller is in the respective first position of the crease roller, wherein a distance between the counter wheel or the supporting device and the respective crease roller is adjustable.

7. The creasing unit according to claim 1, wherein at least one of a depth of the fold line and a depth of an additional indented line is adjustable.

8. The creasing unit according to claim 1, wherein a distance between the crease rollers of the first pair of two crease rollers along the direction that is transverse to the feed direction of the cardboard is set depending on a thickness of the cardboard to be creased.

9. The creasing unit according to claim 1, wherein a distance between the crease rollers of the first pair of two crease rollers along the direction that is transverse to the feed direction of the cardboard is equal to a thickness of the cardboard to be creased.

* * * * *